US007201253B2

(12) United States Patent
Duval et al.

(10) Patent No.: US 7,201,253 B2
(45) Date of Patent: Apr. 10, 2007

(54) SOUNDPROOFING ASSEMBLY AND A PART COMPRISING A WALL WHICH IF COVERED WITH SAID ASSEMBLY

(75) Inventors: Arnaud Duval, Charleville-Mezieres (FR); Guillaume Deshayes, Sedan (FR)

(73) Assignee: Faurecia Automotive Industrie, Nanterre (FR)

( * ) Notice: Subject to any disclaimer, the term of this patent is extended or adjusted under 35 U.S.C. 154(b) by 239 days.

(21) Appl. No.: 10/503,975

(22) PCT Filed: Feb. 11, 2003

(86) PCT No.: PCT/FR03/00430

§ 371 (c)(1),
(2), (4) Date: Aug. 10, 2004

(87) PCT Pub. No.: WO03/069596

PCT Pub. Date: Aug. 21, 2003

(65) Prior Publication Data

US 2005/0103564 A1 May 19, 2005

(30) Foreign Application Priority Data

Feb. 11, 2002 (FR) ..... 02 01648

(51) Int. Cl.
*F01N 1/00* (2006.01)
*E04B 1/82* (2006.01)
*E04B 2/02* (2006.01)

(52) U.S. Cl. ..... 181/204; 181/290; 181/286; 181/294; 180/69.22; 180/69.23; 296/39.3

(58) Field of Classification Search ..... 181/204, 181/286, 290, 294; 296/39.3; 180/69.22, 180/69
See application file for complete search history.

(56) References Cited

U.S. PATENT DOCUMENTS

| | | | | |
|---|---|---|---|---|
| 4,559,255 | A | 12/1985 | Shimode et al. | |
| 5,493,081 | A * | 2/1996 | Manigold | 181/286 |
| 5,584,950 | A * | 12/1996 | Gaffigan | 156/71 |
| 5,824,973 | A * | 10/1998 | Haines et al. | 181/286 |
| 6,123,171 | A * | 9/2000 | McNett et al. | 181/290 |
| 6,631,785 | B2 * | 10/2003 | Khambete et al. | 181/290 |
| 6,983,822 | B2 * | 1/2006 | O'Regan et al. | 181/290 |

FOREIGN PATENT DOCUMENTS

| | | |
|---|---|---|
| WO | 98/18657 | 5/1998 |
| WO | 99/44816 | 9/1999 |

* cited by examiner

*Primary Examiner*—Lincoln Donovan
*Assistant Examiner*—Forrest Phillips
(74) *Attorney, Agent, or Firm*—Young & Thompson

(57) ABSTRACT

A soundproofing assembly intended, in particular, to soundproof a motor vehicle. The inventive assembly includes four stacked layers, consisting respectively of: a first layer having an air resistance of between 500 and 2,000 N·m−3.s; a second porous, acoustic spring-type layer having a resistivity of between 10,000 N·m−4.s and 50,000 N·m−4.s; a third viscoelastic, airtight, heavy mass-type layer having a density that is greater than or equal to 1,500 Kg/m3 and a surface density of between 0.2 Kg/m2 and 9 Kg/m2; and a fourth porous, acoustic spring-type layer having a resistivity of between 10,000 N·m−4.s and 50,000 N·m−4.s.

9 Claims, 1 Drawing Sheet

-15-

SOUNDPROOFING ASSEMBLY AND A PART COMPRISING A WALL WHICH IF COVERED WITH SAID ASSEMBLY

BACKGROUND OF THE INVENTION

The invention relates to a sound-proofing assembly, in particular intended for use in a motor vehicle, as well as a component comprising a wall covered with said assembly.

DESCRIPTION OF THE RELATED ART

A large number of solutions have already been proposed to sound-proof a vehicle. In particular, it is known to use a complex of the spring/mass type comprising a viscoelastic air-tight layer having a high density, forming a heavy mass, and a layer, which is porous with respect to air, forming an acoustically resilient member.

Such a solution has relatively good sound-proofing characteristics and is relatively cheap.

However, taking into consideration the proportion of these sound-proofing members in the total mass of vehicles, manufacturers have been seeking to reduce the mass thereof in order to reduce the fuel consumption of vehicles.

Other solutions have therefore been proposed, and in particular to use instead a complex comprising two layers: one having a relatively high resistance to air passage and the other, which is porous with respect to air, forming the acoustically resilient member.

This solution consists in replacing the air-tight heavy mass with a lighter layer having a resistance to air which is no longer infinite but which is relatively high. Such a solution, disclosed in particular in WO-A-98 18657, allows a substantial reduction in the sound-proofing mass, but it still does not provide sound-proofing of excellent quality.

SUMMARY OF THE INVENTION

In order to overcome the disadvantages of these various solutions, the object of the invention consists in defining a new solution, optimising the relationship between the sound-proofing quality and the weight of the assembly.

To this end, the invention proposes an assembly comprising four superimposed layers constituted respectively by:

- a first layer which has a resistance to air passage of between 500 and 2,000 $N.m^{-3}.s$,
- a second layer which is porous, of the acoustically resilient member type and has a resistivity of between 10,000 $N.m^{-4}.s$ and 50,000 $N.m^{-4}$. S, the first layer covering the second layer,
- a third layer which is viscoelastic, air-tight, of the heavy mass type and has a density greater than or equal to 1,500 $Kg/m^3$ and a surface mass of between 0.2 $Kg/m^2$ and 9 $Kg/m^2$, the second layer covering the third layer,
- a fourth layer which is porous, of the acoustically resilient member type and has a resistivity of between 10,000 $N.m^{-4}.s$ and 50,000 $N.m^{-4}.s$, the third layer covering the fourth layer.

The first pair formed by the first layer and second layer and the second pair formed by the third layer and fourth layer defined in this manner are relatively complementary and combine their effects to produce homogeneous results both in the field of sound-absorption and in acoustic insulation over a wide frequency range.

The applicant has established that the first pair is found to be particularly effective in absorbing not only high frequencies (above 1,000 Hz), but also mid-range frequencies (between 400 Hz and 1,000 Hz), for which the second pair is not very suitable, and that conversely the first pair has average acoustic insulation qualities which are compensated for by the second pair which is relatively effective in this range.

Consequently, taking into consideration the various noises relating to motor vehicles, the solution of the invention is found to be particularly suitable for the field of sound-proofing motor vehicles, in particular for covering the floor, the boot, the bulkhead, the parcel shelf and the door panels. As a result, it is possible to obtain a reduction in weight of between approximately 15% and 35% without reducing the sound-proofing quality perceived in comparison with the solutions of the prior art.

According to a complementary feature intended to optimise the absorption of the first pair of layers, the first layer has a resistivity of between 100,000 $N.m^{-4}.s$ and 400,000 $N.m^{-4}.s$ and/or of between 3 and 20 times the resistivity of the second layer.

By way of information, it is specified that the resistance of a layer to air passage is equal to the product of the resistivity of a layer multiplied by the thickness thereof.

According to another advantageous feature, according to the invention, the fourth layer has a Young's modulus which is at least two times less than the Young's modulus of the second layer.

In this manner, it is possible to reduce the risk that a phenomenon of interference (frequency coincidence) is produced between the two pairs of layers, which further improves the sound-proofing of the solution according to the invention.

The invention further relates to a component comprising, in addition to the assembly, a rigid wall, said assembly at least partially covering said wall and, among said four superimposed layers, the fourth layer being the layer nearest the wall and the first layer being the layer furthest away from said wall.

BRIEF DESCRIPTION OF THE DRAWINGS

The invention will be appreciated even more clearly from the description below which is given with reference to the appended drawings, in which.

DESCRIPTION OF THE PREFERRED EMBODIMENTS

Figure 1:
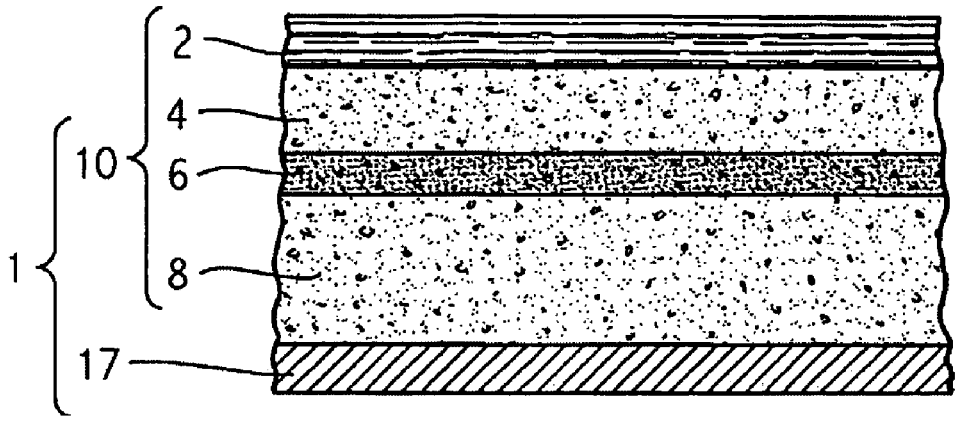
FIG. 1 is a cross-section of an assembly according to the invention.

FIG. 1 illustrates a component 1 comprising a rigid wall and a flexible assembly 10. Said assembly 10 comprises a first layer 2, a second flexible layer 4, a third flexible layer 6 and a fourth flexible layer 8 which are superimposed and which cover a substantially rigid wall 17, to which it is fixed. The component 1 delimits a space 15, such as a vehicle passenger compartment, to be sound-proofed.

The first layer 2 and the second layer 4 are permeable to air, whereas the third layer 6 is impermeable to air. Furthermore, the first layer 2 has a resistance to air passage which is not infinite but which is nevertheless high. In particular, the first layer 2 has a resistivity greater than that of the second layer 4.

In general terms, the third layer 6 and the fourth layer 8 deal with the noise transmitted via solid means and noise transmitted through the air radiated by the wall 17 in order to insulate said wall of the passenger compartment 15. The residual sound waves which are present in the passenger compartment 15 pass in part through the layer 2, then into the layer 4, which forms an acoustically resilient member, where they are absorbed, the viscoelastic, mechanically inert layer 6, which forms a heavy mass and which is supported by the layer 8, also forming an acoustically resilient member which defines a barrier to the sound waves.

Of course, this presentation is simplistic. However, it illustrates the principal functions carried out by each of the layers.

In this case, the first layer 2 has a substantially uniform composition, in particular in terms of resistivity, over the entire thickness thereof and further constitutes the trim layer of the component 1. It has a thickness greater than or equal to 4 millimeters, advantageously of between 5 and 10 millimeters.

In particular, it can be constituted by glass, cotton or synthetic fibres (polyester, polypropylene, polyamide, acrylic) and polypropylene. By way of a variant, it can also be constituted by a compacted non-woven fabric, a needled fabric, or the like, coated with latex. It is also possible to cover the first layer 2 with a trim layer, whose resistance to air passage is negligible in relation to that of the first layer. This is the case with some velours and some floor carpets.

The second layer and the fourth layer are each advantageously constituted by thermoplastic foam or felt. They can both be produced from the same material, but that is not necessary. Their density is advantageously between 15 $Kg/m^3$ and 100 $Kg/m^3$. Their porosity (proportion of air confined for a given volume) is advantageously greater than 0.9 and preferably greater than 0.95. Each of the layers advantageously has a thickness of between 5 millimeters and 20 millimeters.

The heavy mass 6 advantageously comprises a thermoplastic material of the polyolefin type (ethylene vinyl acetate, polythene, ethylene propylene diene monomer) and incorporates waste products of the bitumen, chalk and/or barium sulphate type, permitting a high density at low cost. Its Young's modulus is less than 1,000 MPa and it has a density greater than or equal to 1,500 $Kg/m^3$, preferably greater than or equal to 2,000 $Kg/m^3$, a surface mass of between 0.2 $Kg/m^2$ and 9 $Kg/m^2$ and advantageously a thickness of between 0.1 millimeters and 5 millimeters.

The thickness of the assembly 10 is advantageously between 15 millimeters and 50 millimeters.

The connection between the layers is produced according to conventional techniques, in particular by thermo-adhesive bonding.

Figure 2:
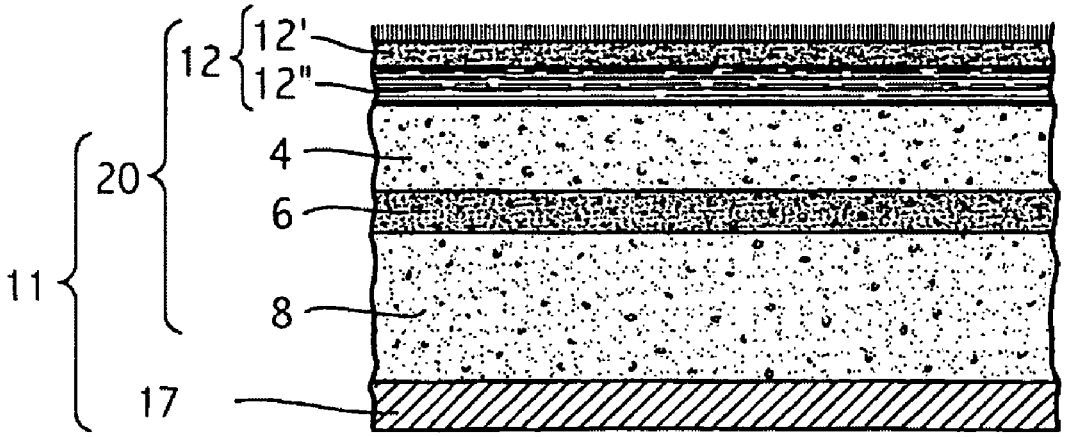
FIG. 2 is a cross-section of a variant of the assembly of FIG. 1.

FIG. 2 illustrates a component 11 which differs substantially from the component 1 illustrated in FIG. 1 in that it comprises an assembly 20 which differs from the assembly 10 in that the first layer 2 has been replaced with a first layer 12 comprising two superimposed portions 12', 12". As illustrated by way of example, the portion 12' could be constituted by a carpet support (needled fabric coated with latex by complete immersion, for example), that is to say, a trim layer having a non-negligible resistance to air passage, and the portion 12" having compressed fibres (for example, compressed felt).

Naturally, the invention is in no way limited to the embodiment described above by way of non-limiting example. In this manner, the first layer 2, 12 could comprise more than two superimposed portions.

The invention claimed is:

1. Assembly for sound-proofing in particular a motor vehicle, comprising four superimposed layers constituted respectively by:

a first pair of sound-absorbing layers having a sound-absorbing property and structured to perform a sound-absorbing function, the first pair of layers comprising a first layer which has a resistance to air passage of between 500 and 2,000 $N.m^{-3}.s$, a second layer which is porous, of the acoustically resilient member type and has a resistivity of between 10,000 $N.m^{-4}.s$ and 50,000 $N.m^{-4}.s$, the first layer covering the second layer, a second pair of spring-mass layers having a sound-insulating property and structured to perform a sound-insulating function, the second pair of spring-mass layers comprising a third layer which is viscoelastic, airtight, of the heavy mass type and has a density greater than or equal to 1,500 $Kg/m^3$ and a surface mass of between 0.2 $Kg/m^2$ and 9 $Kg/m^2$, the second layer covering the third layer, a fourth layer which is porous, of the acoustically resilient member type and has a resistivity of between 10,000 $N.m^{-4}.s$ and 50,000 $N.m^{-4}.s$, the third layer covering the fourth layer, the third layer being connected to the second layer.

2. Assembly according to claim 1, wherein the first layer has a resistivity of between 100,000 $N.m^{-4}.s$ and 400,000 $N.m^{-4}.s$.

3. Assembly according to claim 1, wherein the first layer has a resistivity of between 3 and 20 times the resistivity of the second layer.

4. Assembly according to claim 1, wherein the third layer has a Young's modulus of less than 1,000 MPa and a density of greater than or equal to 2,000 Kg $/m^3$.

5. Assembly according to claim 1, wherein the fourth layer has a Young's modulus which is at least two times less than the Young's modulus of the second layer.

6. Assembly according to claim 1, wherein the second layer and the fourth layer are constituted by thermoplastic foam and/or felt and have a density of between 15 $Kg/m^3$ and 100 $Kg/m^3$.

7. Assembly according to claim 1, wherein the third layer comprises a thermoplastic material of the polyolefin type and incorporates waste products of the bitumen, chalk and/or barium sulphate type.

8. Component comprising a rigid wall and an assembly according to claim 1, wherein said assembly at least partially covers said wall and, among said four superimposed layers, the fourth layer is the layer nearest the wall and the first layer is the layer furthest away from said wall.

9. Assembly according to claim 1, wherein the third layer is connected to the fourth layer by thermo-adhesive bonding.

* * * * *